United States Patent [19]

White et al.

[11] 4,347,442

[45] Aug. 31, 1982

[54] DOUBLE INSULATED STARTER MOTOR

[75] Inventors: Dale A. White, Eaton Rapids; Paul P. Kluwe, Vermontville; Leon D. Greenwood, Eaton Rapids, all of Mich.

[73] Assignee: Eaton Stamping Company, Eaton Rapids, Mich.

[21] Appl. No.: 168,135

[22] Filed: Jul. 14, 1980

[51] Int. Cl.[3] ..... F02N 11/14

[52] U.S. Cl. ..... 290/48; 290/38 R

[58] Field of Search ..... 290/38, 48; 310/43, 310/192, 194

[56] References Cited

U.S. PATENT DOCUMENTS

| | | | |
|---|---|---|---|
| 3,500,085 | 3/1970 | Smith | 290/38 R |
| 3,536,051 | 10/1970 | Hamman | 290/38 R |
| 3,546,503 | 12/1970 | Richardson | 310/194 X |
| 3,791,684 | 2/1974 | Hamman | 290/38 |
| 3,791,685 | 2/1974 | Hamman | 290/38 |
| 3,908,139 | 9/1975 | Duncan, Jr. | 310/43 X |
| 3,978,357 | 8/1976 | Voelbel et al. | 310/43 X |
| 4,175,237 | 11/1979 | Mazzorana | 290/38 R |

*Primary Examiner*—J. V. Truhe
*Assistant Examiner*—W. E. Duncanson, Jr.
*Attorney, Agent, or Firm*—Beaman & Beaman

[57] ABSTRACT

The invention pertains to electric starter motors for internal combustion engines, particularly motors used with smaller engines such as employed to power lawn mowers, snow blowers, lawn tractors and similar equipment. The motor housing is formed of a dielectric material as to be doubly electrically insulated for protection against electrical shock, the motor casing features simplify assembly of the field coil within the casing, and the motor armature shaft portion and starter pinion shaft portion are formed as two components, rather than the usual one piece, permitting separate heat treatment and eliminating the need for shaft straightening after hardening as required when the armature and pinion shaft are homogeneously formed. Improved frictional engagement between the starter pinion and starter drive nut is achieved by the use of a low friction slip ring, and the operating switch for the starter is encompassed within a dielectric, weatherproof receptacle which may be readily assembled and is tamperproof to protect against shock even under high moisture conditions.

15 Claims, 10 Drawing Figures

DOUBLE INSULATED STARTER MOTOR

BACKGROUND OF THE INVENTION

Lawn and garden equipment employing internal combustion engines above three or four horsepower are often offered with starting equipment options. For instance, such engines normally include a recoil rope starter for permitting manual engine starting. Additionally, an electric starter motor option is often available wherein 110 volt AC house current may be employed to energize a starter motor to crank the engine for starting purposes. Electric starters permit women and children to use heavier horsepower equipment than otherwise possible, and electric starters are popular with "walk behind" snow blowers in that the manual cranking of a snow blower engine in cold weather is difficult.

In that lawn and garden equipment often becomes wet, and snow blowers often accumulate snow thereon, it is desirable that the starter motor and associated switch structure be electrically insulated as highly as possible to protect the user against electrical shock, and while tools such as hand power drills, hedge trimmers, and the like have long been doubly insulated, such electrical protective constructions have not commonly been used in starter motors for internal combustion engines.

Starter motors for small internal combustion engines normally include an armature shaft having a cantilevered portion extending from the motor casing upon which Bendix type starter structure is mounted, as shown in the assignee's U.S. Pat. No. 3,791,684. As the starter structure includes threads cooperating with nut apparatus which is axially translated by the motor shaft rotation it is necessary to harden the cantilever portion of the shaft for wear-resistant purposes. Accordingly, it has been necessary to heat treat the entire armature and starter shaft even though the portion of the shaft upon which the starter structure is not mounted does not require hardening and the shaft heat treatment often distorts the shaft requiring time consuming and expensive straightening.

In the electric engine starters of the aforementioned type the Bendix type starter structure may include a starter pinion rotatively mounted upon a nut member and a frictional driving relationship is produced between the gear and nut member by an elastomeric material on the nut member which frictionally engages the gear. As the torque transmission of the gear increases the frictional engagement between the elastic material and gear increases, and the elastic material will produce a cushioning effect both during cranking, and during initial engagement between the pinion gear and the engine flywheel teeth. The presence of a cushioning elastomeric member between the starter pinion and starter nut is shown in the assignee's U.S. Pat. No. 3,791,685 and the instant invention presents improvements over this prior teaching.

The electric starter motor is operated by switch structure associated with the electrical conductors for interconnecting the motor with the household 110 volt AC electrical supply. The switch structure of prior art electrical starter motors for use with lawn and garden equipment has not been as watertight and protective against the possibility of electrical shock as desired, and as the switch structure, as well as the starter engine structure, provides the possibility for electrical shock, and these components, together, contribute to the safety of the starter apparatus, it is important that the starter switch as well as the starter motor casing be capable of meeting high dielectric safety requirements.

OBJECTS OF THE INVENTION

It is an object of the invention to produce a starter motor for internal combustion engines which is doubly insulated with respect to electrical conductivity, and wherein the motor casing, housing end caps, pinion gear and exposed parts are formed of dielectric material.

An additional object of the invention is to provide an electric motor starter for internal combustion engines wherein the motor armature shaft structure is formed of two shaft portions which may be machined and heat treated separately, and assembled into an integral unit capable of transmitting the torque forces required for engine starting.

A further object of the invention is to provide a starter motor casing having field coil centering and retaining elements defined upon the inner surface thereof, whereby insertion of the field coil within the casing will automatically center the field coil therein.

An additional object of the invention is to provide an electric starter drive for starting internal combustion engines wherein the drive is of the Bendix type and utilizes a nut member and light weight synthetic plastic pinion gear having an elastomeric friction material interposed therebetween wherein the nut member frictionally rotates the pinion gear and the elastic material absorbs both axial and rotative shock forces imposed upon the gear, the degree of cushioning produced by the resilient material varying in accordance with the axial forces existing between the pinion gear and nut member.

Yet another object of the invention is to provide an electric switch assembly for use with a double insulated electric starter motor wherein the switch assembly is weather tight, is not likely to short under humid conditions, and wherein assembly of the switch components may be readily achieved, and yet disassembly and tampering is prevented.

A further object of the invention is to provide a Bendix type starter for small internal combustion engines wherein malfunctioning due to starter components freezing together is reduced.

In the practice of the invention the electric motor includes a generally cylindrical casing having end caps mounted thereon by tie rods, the casing and end caps being formed of a dielectric synthetic plastic material. Internally, the casing is provided with a plurality of axially extending projections homogeneously formed of the casing material and radially extending inwardly from the casing inner surface. The projections are of a generally triangular cross section increasing in radial dimension in a common axial direction wherein the insertion of a field coil into the casing causes the field coil to engage and deform the elements producing a simultaneous centering and retaining of the field coil within the casing.

The electric motor includes an armature mounted upon a shaft which has an end received within a splined socket coaxially formed within a cantilevered shaft extending from the motor casing upon which the starter structure is mounted. The armature shaft is keyed to the cantilevered shaft portion by the splines wherein rotative forces are transmitted between the shafts, and assembly of the shafts occurs after heat treatment eliminating any necessity for armature shaft straightening, as is the usual practice.

An elastomeric material bonded upon a nut member mating with threads upon the cantilevered shaft portion engages the starter pinion gear during cranking, and a slip ring between the nut and gear produces a clutching action. The frictional engagement between the resilient material and the gear permits a frictional drive of the gear during cranking, and the slip ring permits soft initial axial cushioning and ease of gear alignment with the engine flywheel gear teeth. Cushioning varies in accord with the extent of the axial force imposed upon the pinion gear by the nut member.

The switch assembly which controls the operation of the starter motor constitutes a receptacle formed of synthetic dielectric material and seals associated with an electrical connector, and a cord, are received within openings defined in the receptacle wherein the placement of a cap upon the receptacle simultaneously seals an electrical switch therein, and achieves a watertight interconnection between the connector and cord with the switch receptacle. The receptacle cover includes a plurality of pins received within sockets defined in the receptacle and the respective dimensions between the socket and pins is such that an interference fit occurs upon assembly of the cap to the receptacle, this interference fit precluding removal of the cap from the receptacle.

The elastic material molded to the nut member includes an axial portion extending toward the adjacent motor casing end cap, and structure defined upon the end cap cooperates with the nut member elastic material to produce a "freeze ring" wherein the freezing of water between the elastic material and the end cap structure will produce a reactive resistance force on the nut member assuring rotation of the nut member on the shaft threads and axial movement thereof during the cranking operation even though the nut member and threads may be initially frozen together.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
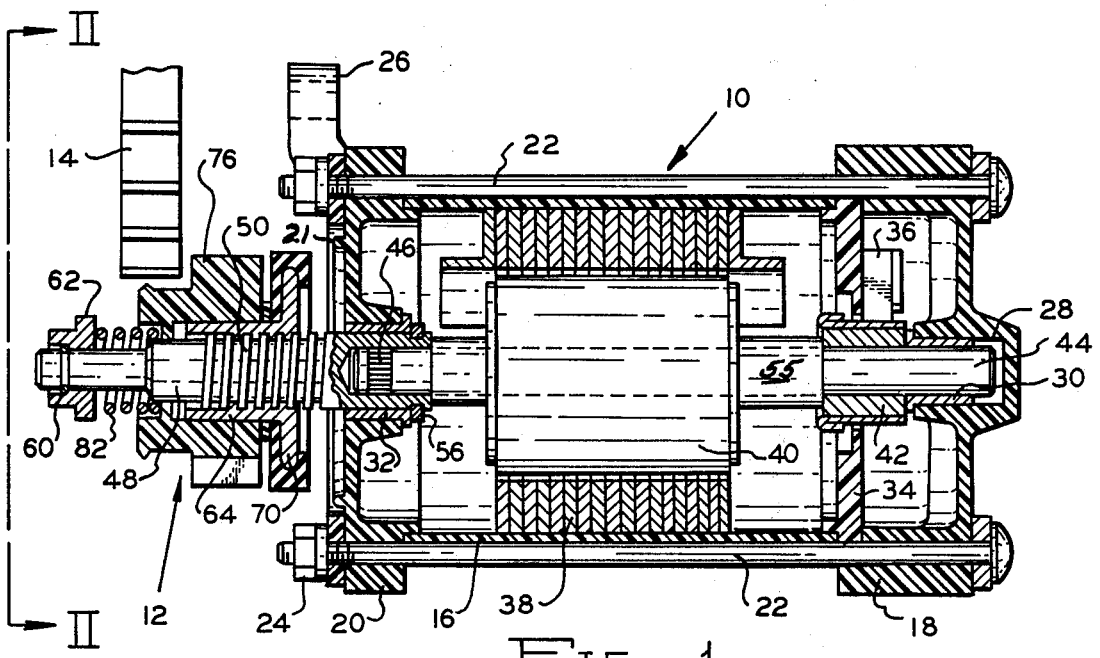
FIG. 1 is a diametrical, sectional, elevational, cross-sectional view of a doubly insulated electric starter motor in accord with the invention.

With reference to FIG. 1, an electric starter motor assembly for internal combustion engines in accord with the invention is generally indicated at 10, and the starter includes a Bendix type starter generally indicated at 12 for cooperation with the engine flywheel having teeth 14 defined on the periphery thereof in the known manner.

The electric motor housing includes a cylindrical casing 16 which is formed of a dielectric synthetic plastic material of a rigid material such as sold under the trademark Ryton R8700GA as produced by the Phillips Corporation, and the ends of the casing 16 are enclosed by dielectric synthetic plastic end caps 18 and 20 which are molded of a similar material. The end caps are provided with a plurality of bores for receiving tie rods 22 provided with a head at the end adjacent end cap 18, and threaded at the end adjacent end cap 20 whereby nuts 24 tension the tie rods to maintain the end caps upon the casing 16. The starter assembly is mounted upon the associated engine, not shown, by means of mounting bracket arms 26, FIG. 2, which may be homogeneously defined upon the end cap 20, or may be defined upon a mounting ring held upon the end cap 20 by the tie rod nuts 24.

End cap 18 is provided with a coaxial bearing socket 28 which receives the annular friction bearing 30, and end cap 20 is provided with a central opening which receives the annular friction bearing 32. A dielectric brush card 34 is located at the right end of the casing 16, FIG. 1, and is held in place by the end cap 18. The brush card 34 supports the brushes 36 which engage the armature commutator 42 in the known manner.

The casing 16 houses a field assembly 38 which may be formed of a plurality of laminations, such as described in U.S. Pat. No. 3,791,684, and the field assembly is wound with an electrical conductor, not shown, in order to produce the necessary electric field for influencing the armature 40 in radial alignment with the field coil 38. As will be later described, the field coil 38 cooperates with centering elements defined on the inner surface of the casing 16 for positioning the coil within the casing.

Figure 5:
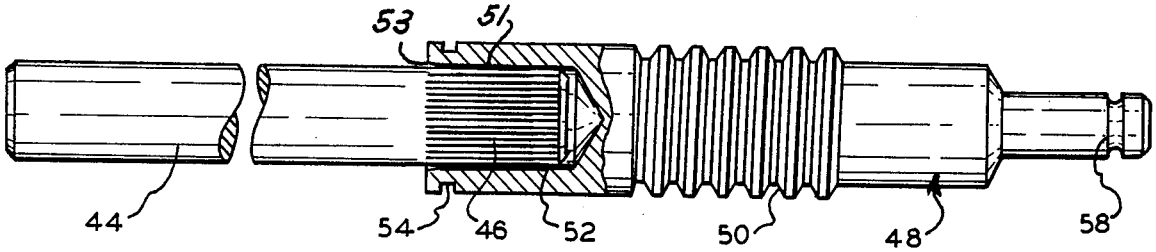
FIG. 5 is an elevational view, partially in section, illustrating the construction of the armature and cantilever shaft structure, per se.
Figure 8:
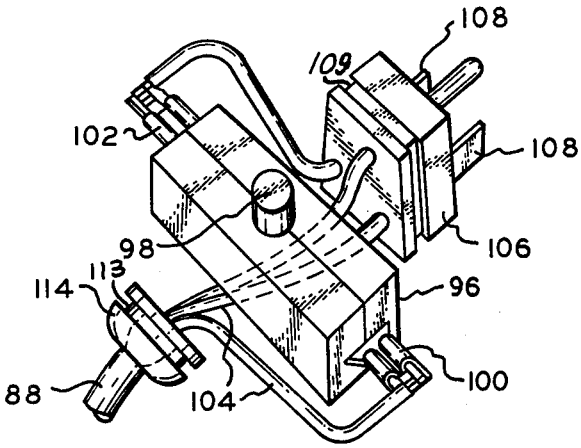
FIG. 8 is a perspective, exploded view of an electric switch assembly in accord with the invention, the switch components being removed from the receptacle, and the cap being removed from the receptacle.

The armature 40 and the starter structure 12 are mounted upon a two portion shaft assembly illustrated in FIG. 5. The shaft assembly includes an interior non-hardened cylindrical armature portion 44 and the hardened cantilevered exterior portion 48. The cantilever shaft portion 48 includes threads 50 defined thereon, and a socket 52 is formed in an end of the shaft portion 48 which is provided with spline teeth 51 intersected by conical surface 53, and the splined socket is of a smaller diameter than shaft 44 so that forcing shaft 44 into socket 52 causes the material of shaft 44 to flow between splines 51 producing a keying action permitting high torsion forces to be transmitted between portions 44 and 48, and the axial extent of cooperation between the shaft portions within socket 52 is sufficient to produce a rigid integral assembly.

A snap ring groove 54 defined adjacent the inner end of shaft portion 48 permits a snap ring 56, FIG. 1, to be received therein and about against a thrust washer at bearing 32. In this manner the bearing 32 supports the left end of the armature shaft assembly, FIG. 1, and supports the inner end of the cantilever shaft portion 48.

Figure 3:
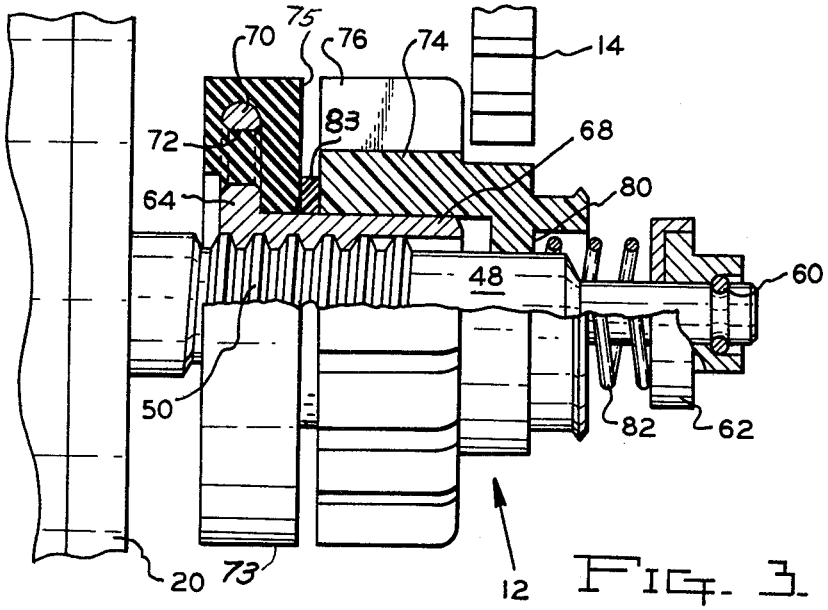
FIG. 3 is an enlarged, elevational, detailed, partially sectioned view illustrating the starter pinion gear and associated structure in a non-cranking condition prior to engagement of the gear with the flywheel.

The outer reduced diameter end of shaft portion 48 is provided with an annular groove 58 which receives the stop snap ring 60, FIG. 3, for positioning the stop 62 on the outer end of the shaft portion 48. Stop 62 limits the movement of the pinion gear during engine cranking, as will be later described.

The two-piece construction of the armature and starter shaft assembly provides an advantage over single piece shaft designs. For instance, it is necessary to heat treat the starter shaft portion 48 for wear resistance purposes, and with a single piece shaft such heat treatment usually "warped" the shaft requiring a straightening operation. With the two portion construction of the invention only portion 48 need be hardened, which will eliminate a straightening operation with respect to portion 44 which must run true. The armature 40 is mounted on the portion 44 between insulating end sleeves 55, FIG. 1.

The Bendix type starter structure 12 includes an annular nut member 64 provided with a threaded bore 66 which mates with the shaft threads 50. The nut member also includes an annular hub portion 68 having a cylindrical outer surface which rotatively supports the starter pinion gear. Nut member 64 includes a radial flange 70, and several axially extending holes 72 may be defined within the flange 70. An elastic resilient material 73, such as rubber, or the like, is bonded to the flange 70 and includes a face 75 provides cushioning as later described.

Figure 4:
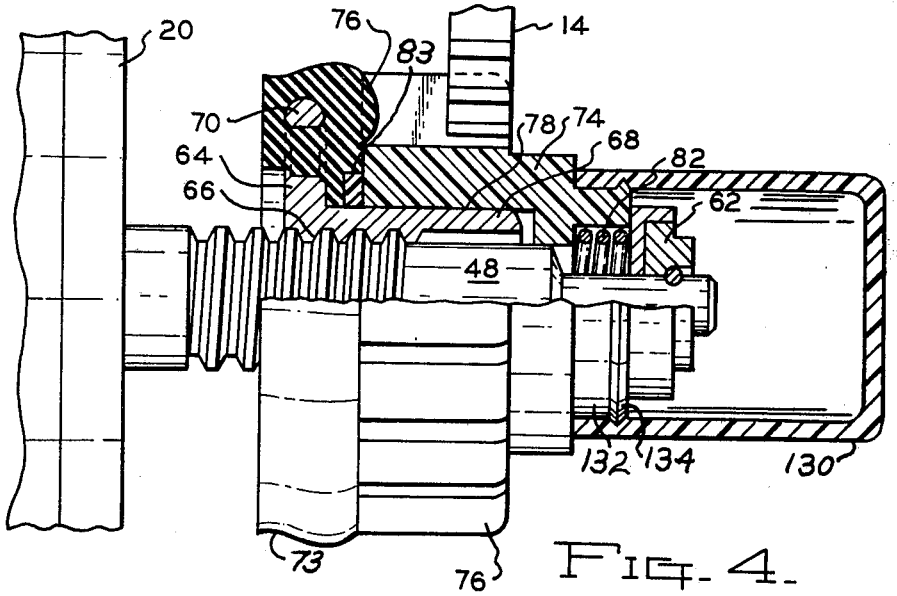
FIG. 4 is a view similar to FIG. 3 illustrating the relationship of the starter components during engine cranking.

The synthetic plastic starter pinion gear 74 includes gear teeth 76 and is internally provided with a cylindrical surface 78 rotatively and axially movable upon the nut member hub 68. An annular inwardly extending radial shoulder 80 is defined upon the gear 74, and a compression spring 82 interposed between shoulder 80 and stop 62 biases the gear 74 toward the resilient material 73 for engagement with the Teflon slip ring 83 located between gear 74 and face 75 of material 73. The ring 83 engages the gear 74 radially inwardly of the teeth 76, and because of the limited radial dimension of the ring 83 a soft initial axial cushioning action will occur between the nut member 64 and gear 74 when axial gear movement is resisted. When the motor 10 is energized and the shaft 44 is rapidly rotated, the shaft 48, and threads 50, will initially rotate relative to the nut 64 causing the nut 64 to be translated toward the right, FIGS. 3 and 4, and this axial translation of the nut toward the right axially translates gear 74 toward flywheel teeth 14, compressing spring 82. Should the pinion gear teeth 76 and flywheel gear teeth 14 initially misalign the low friction of ring 83 will permit gear 74 to rotate slightly to alignment and ring 83 may embed slightly into face 75 permitting the nut member to move its fullest extent toward the right as shown in FIG. 4 wherein the outer end of the gear 74 will engage the stop 62 and ring 83 will embed into face 75 to provide an initial soft cushioning. As will be noted in FIG. 4, when gear teeth 76 and 14 are fully engaged under high torque cranking conditions the resilient material 73 extrudes into the gear teeth, as shown in FIG. 4, and the material 73 frictionally rotates the gear 74.

Upon the engine starting the increased rate of rotation of the flywheel gear teeth 14 will rotate the gear, and the nut, upon shaft 48 at a greater rate of rotation than during cranking, causing the nut and gear to be axially displaced toward the left, FIG. 3, disengaging the flywheel teeth 14 and pinion starter gear teeth 76. The spring 82 will prevent inadvertent engagement of the starter pinion and flywheel gear teeth due to vibration during engine running.

As noted in FIG. 3, the slip ring 83 engages gear 74 inwardly of teeth 76, and due to the limited amount of elastic material in axial alignment with ring 83 the ring will readily embed in the material. Soft cushioning of the gear 74 is thereby initially provided and as the axial force between the nut member 64 and gear 74 increases the face 75 will directly frictionally engage gear 74 and the resilient material 73 will extrude between teeth 76, FIG. 4, to produce an effective frictional rotation of the gear 74 during engine cranking. The light weight gear 74 will have a low inertia and does not wear aluminum flywheel teeth.

Figure 6:
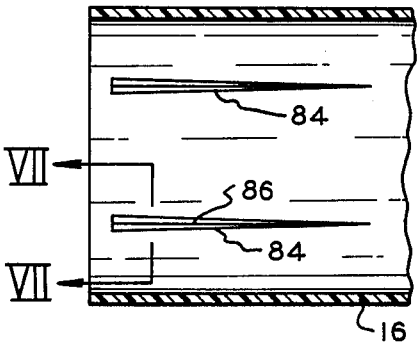
FIG. 6 is an elevational, sectional, detailed view of the electric motor casing illustrating the centering and retaining elements.
Figure 7:
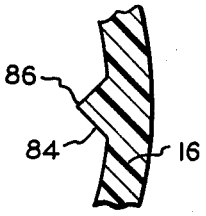
FIG. 7 is an enlarged, elevational, sectional, detailed view of a centering and retaining element as taken along section VII—VII of FIG. 6.

With reference to FIGS. 6 and 7, a feature of the casing 16 is illustrated. Internally, the casing 16 is provided with a plurality of elongated centering and retaining elements which extend substantially $\frac{3}{4}$ of the length of the casing 16, and four of such elements are located on the inner surface of the casing, the elements being in diametrically opposed relationship to each other. The centering and retaining elements are defined by converging surfaces 84, FIG. 7, extending from the casing 16 which intersect at an apex 86. The elements are homogeneously defined of the synthetic plastic material of the casing 16 and gradually increase in radial dimension in a common axial casing direction, i.e. toward the left as viewed in FIG. 6. When the field coil 38 is axially inserted into the casing 16 the field coil is forced into the casing from the right end thereof, FIG. 6, and will engage with the apexes 86. In that the field coil is formed of metal plates, and apexes 86 are of a softer synthetic plastic construction, the forcing of the field coil into the casing 16 will cause the field coil to scrape off a portion of the apexes 86 accurately centering the coil within the casing 16 due to the diametrical orientation of the centering and retaining elements.The elements 84–86 "wedge" the coil in position, and the resultant interference fit will assure a coaxial alignment of the field coil with the axis of the casing 16.

Figure 7A:
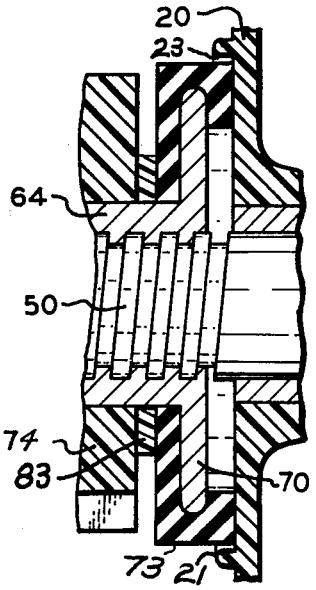
FIG. 7A is an enlarged, detailed, elevational, sectional view of the casing end cap freeze ring in cooperation with the starter structure.

Another unique feature of the starter of the invention is shown in detail in FIG. 7A. In cold weather it is possible for water to enter the starter structure 12 due to snow or rain, and water may enter the threads 50 causing the shaft 48 to freeze to nut member 64. Such freezing would cause the nut 64 to rotate integrally with the armature shaft upon energizing of the motor preventing the relative rotation between threads 50 and nut 64 necessary to axially translate the nut and gear 74 for meshing the gear with the flywheel teeth 14. This possibility especially exists when the starter is used with snow blowers.

To prevent such a starter malfuncton due to freezing a "freeze ring" is employed to retard initial rotation of the nut member 64. The freeze ring comprises an annular ridge 21 defined on the outer surface of end cap 20 concentric to the bearing 32. The inner diameter of ridge 21 is slightly greater than the diameter of the elastic material 73, note FIG. 7A, so that when the nut member 64 and gear 74 are fully retracted and material 73 is engaging end cap 20 an annular clearance 23 of small dimension exists between ridge 21 and the outer diameter of material 73. Under snow or wet conditions water will accumulate within the clearance 23, and at a freezing temperature the entrapped water will freeze to the ridge 21 and the elastic material 73.

When the temperature is cold enough to freeze the water in clearance 23, the nut member 64 may also be frozen to threads 50. However, upon energizing the motor 10 the ice within clearance 23 will provide a greater resistance to nut rotation than the torque applied to the nut 64 by frozen threads 50 thereby "breaking" the nut 64 free of the threads. As soon as the threads 50 rotate relative to nut 64 the nut is axially translated on the threads and the ice within clearance 23 will break away. The aforedescribed operation will occur due to the greater torque arm at clearance 23 as compared to that at threads 50, and the elastic nature of material 73 aids in releasing the nut as axial force is imposed thereon.

Figure 2:
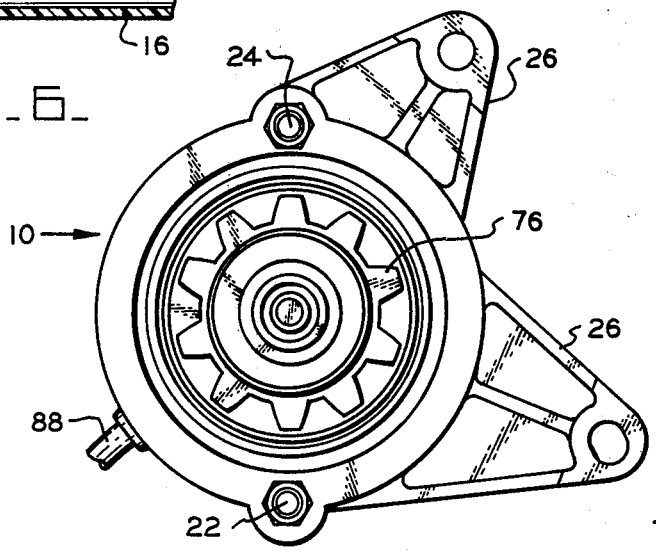
FIG. 2 is an end elevational view as taken along section II—II of FIG. 1, the flywheel gear teeth not being shown.

Electricity is supplied to the motor assembly 10 through electrical cord 88, FIG. 2, and a switch assembly generally indicated at 90 is located adjacent a male connector for the cord, and as the switch assembly must be dependable in operation, and protect against electric shock, the switch assembly apparatus is considered to be a significant aspect of the electric starter motor apparatus of the invention as the dielectric character, dependability of operation and tamperproof construction are directed toward objects commensurate with those of the entire starter assembly.

The switch assembly 90 includes a receptacle 92 including elongated planar side walls interconnected by end walls, and the edges of the side and inner walls are interconnected at one end by a panel 93 at one end, and the side and end walls are open at the other edge forming a cavity opening edge 95 for the casing 92. The casing opening edge 95 is enclosed by a cap 94 which has a periphery complimentary to the cavity opening and includes mounting pins for positioning the cap upon the switch receptacle 92, as later described.

The electric switch 96 is formed within a dielectric body and may be of conventional standard construction utilizing a push button acutator 98 such that depressing the button 98 closes the switch contacts establishing electrical connection between the switch terminals 100 and 102, and a spring, not shown, biases the actuator 98 in an outward direction to a normally open condition to break the circuit between terminals 100 and 102. Conductors 104 within the cord 88 connect to terminal 100 and to connector 106 which is formed of a compressible elastic material and includes connector prongs 108 for reception into a standard extension cord 110 volt AC outlet. The compressible body 106 is of a truncated wedge configuration and includes a recess 109 whereby the recess may be closely received within a complimentarily shaped connector opening 110 defined in a side wall of the switch receptacle 92. In the opposite receptacle side wall a cord opening 112 is defined which is of a U configuration to receive the groove 113 defined in the grommet 114 formed on cord 88, and the grommet 114 is complimentary in configuration to opening 112 as to be sealingly associated therewith.

The cap 94 is fixed upon the switch receptacle 92 in a tamperproof manner which may be readily accomplished during assembly of the switch. The receptacle 92 includes a plurality of sockets 116 of cylindrical configuration which are molded into the receptacle 92, and molded bosses are defined in the receptacle to provide adequate wall thickness about the sockets 116. A concentric cylindrical countersink or recess 118 is defined adjacent the entrance of each socket 116 to facilitate entrance of the pins 120 defined upon cap 94 into the sockets 116.

Figure 9:
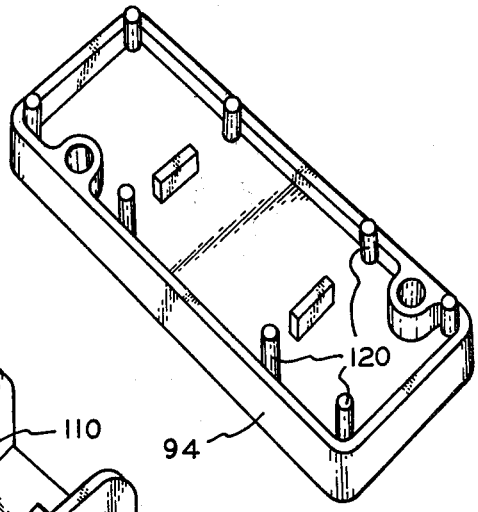
FIG. 9 is an elevational side view of the switch structure, sectioned to show the relationship of a cap pin and a receptacle socket.
Figure 9:
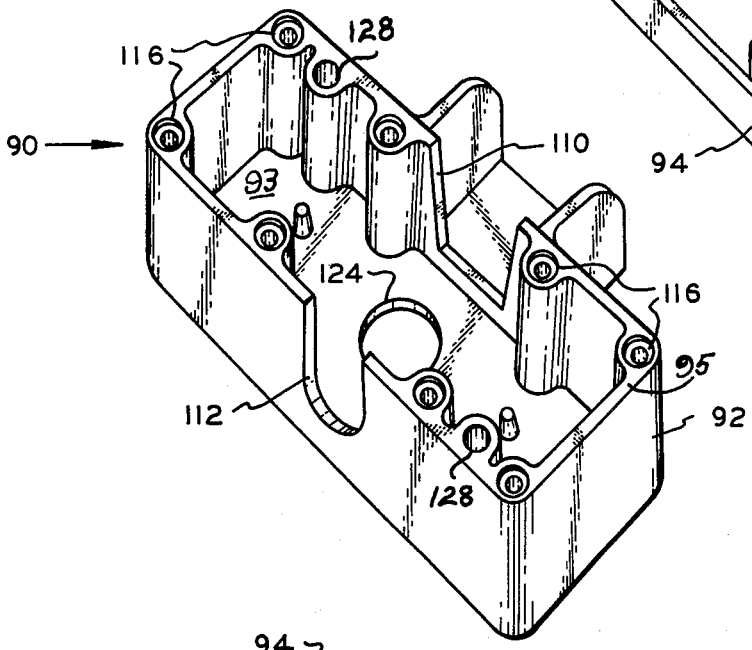
Figure 9:
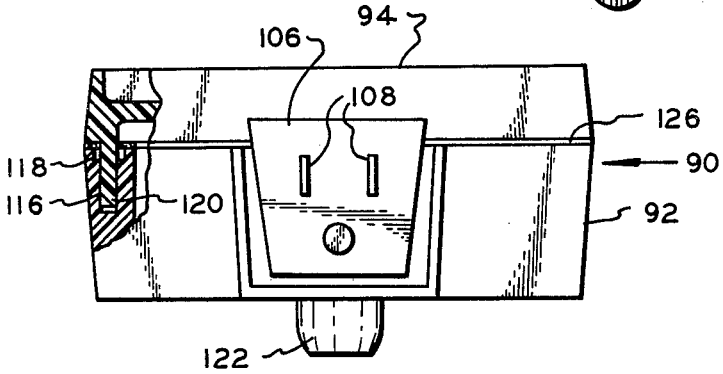

To assemble the switch a resilient cup shaped boot 122, FIG. 9, is placed over the switch actuator 98, and this boot extends through the opening 124 defined in the casing panel 93. The resilient boot 122 includes a flange, not shown, which engages the panel 93 and the dimensions of the switch 96 and the switch receptacle are such that in the fully assembled relationship the boot 122 is sealed with respect to the receptacle 92, and the flexible nature of the boot 122 permits the actuator 98 to be depressed with the finger through the boot. Upon the switch 96 being placed within receptacle 92, the grommet 114 is located within the cord opening 112, and the compressible connector 106 is located within the connector opening 110. Thereupon, a gasket 126 which corresponds in shape to edge 95 is placed upon the receptacle opening edge 95, and the cap 94 is located on the receptacle with the pins 120 received within recesses 118. The cap 94 is then firmly pushed toward the receptacle 92 by an appropriate press forcing the pins 120 into the sockets 116. As the diameter of the pins 120 is several thousandths larger than the diameter of the sockets 116 an interference fit occurs between the pins and sockets producing a very tight frictional interconnection therebetween preventing the cap from being removed from the receptacle 92. The recesses 118 permit the pins to accurately align with the sockets 116 if slight misalignment occurs. During the assembly of the cap 94 to the receptacle the cap edge will be received within that portion of the connector body groove 109 and the grommet groove 113 disposed adjacent the receptacle opening edge 95, and the assembly of the cap to receptacle 92 forces the body 106 and grommet 114 into a fluid tight relationship with the associated receptacle edges 110 and 112 resulting in a weatherproof switch for the starter motor assembly. The switch 90 is mounted by screws extending through insulated mounting holes 128 and may be readily operated by depressing actuator 98 through the boot 122 for engine starting purposes.

In operation, it is merely necessary for the operator to insert an extension cord receptacle upon the connector prongs 108 and depressing the boot 122, and actuator 98, will energize the electric motor 10 to rotate the armature shaft structure. The initial rotation of the armature shaft portion 48 will axially translate the nut member 64 toward the gear 74 producing engagement between the gear teeth 76 and flywheel teeth 14 and the resilient material 73 rotates the gear 74 to crank the engine. Upon the engine starting the pinion gear and flywheel gear will disengage, as previously described, and the operator will release actuator 98. The extension cord is then removed from the switch assembly, and the apparatus powered by the started engine will be used as desired.

A dielectric sleeve 130 is mounted upon the gear surface 132 by a lip 134, as shown in FIG. 4 and omitted in the other figures for clarity of illustration, and this sleeve encompasses the outer end of shaft portion 48, stop 62 and spring 82 and contributes to the double insulation of the starter, as well as protecting these components from foreign matter.

It is appreciated that various modifications to the inventive concepts may be apparent to those skilled in the art without departing from the spirit and scope of the invention.

We claim:

1. A starter for internal combustion engines characterized by its dielectric nature and economy of construction comprising, in combination, a synthetic plastic tubular casing having an inner surface and ends, a synthetic plastic end cap mounted on each casing end, connector means mounting said end caps upon said casing, a bearing mounted in each of said end caps, an electric field coil mounted within said casing having a diameter slightly less than the diameter of said casing inner surface, armature shaft structure supported on said bearings including a cantilever portion extending exteriorly of an end cap and a coaxial interior portion within said casing, an armature defined on said shaft structure interior portion within said field coil, armature brushes within said casing energizing said armature, said armature shaft cantilever and interior portions comprising separate interconnected shafts, connection means interconnecting said cantilever and interior portion shafts providing an integral armature shaft structure assembly, and starter pinion gear means mounted upon said cantilever portion.

2. In a starter as in claim 1, said cantilever portion shaft comprising hardened steel and said interior portion shaft comprising unhardened steel.

3. In a starter as in claim 1, said shaft structure connection means comprising a first end defined on said cantilever shaft, an axially extending socket defined in said shaft end, axially extending splines defined in said socket, a second end defined on said interior shaft of a diameter greater than the minimum diameter of said splines, the material of said second end flowing into engagement with said splines upon said second shaft end being pressed into said socket establishing a mechanical rotary motion transmitting interconnection between said cantilever and interior shaft portions.

4. An electric motor having a synthetic plastic tubular casing having an axis, an inner surface and ends, end caps affixed to the casing ends, an electric field coil formed of rigid elements defining an outer diameter within the casing, and an armature rotatably supported upon the end caps within the field coil, the improvement comprising, deformable centering and retaining elements homogeneously defined upon the casing inner surface engaging the armature field coil outer diameter centering the field coil with respect to the casing axis.

5. In an electric motor as in claim 4, said centering and retaining elements being circumferentially spaced about the casing axis upon the casing inner surface and extending substantially parallel to the casing axis.

6. In an electric motor as in claim 5, wherein said elements radially project inwardly of the casing inner surface and include a deformable apex defining the inwardmost portion of the element.

7. In an electric motor as in claim 6, the said elements increasing in radial dimension along their length in a common axial direction.

8. In an electric motor as in claim 7, said elements uniformly increasing in radial dimension in said common axial direction.

9. In an electric motor as in claim 7, said elements being of a triangular transverse cross section, intersecting sides of substantially equal radial dimension defining said apex at their intersection.

10. In an electric starter for internal combustion engines including an electric motor having a drive shaft, threads defined on the drive shaft, a starter pinion gear assembly mounted on said shaft cooperating with the shaft threads axially movable between operative and inoperative positions, and gear assembly stop means mounted on the shaft, the improvement comprising, the starter pinion gear assembly including an annular nut having a threaded bore cooperating with the shaft threads, a cylindrical hub and a radial flange extending from said hub, a pinion gear rotatably mounted on said hub having gear teeth defined thereon intersecting a gear end, a resilient frictional cushion ring interposed between said nut flange and gear end, an annular slip ring interposed between said cushion ring and gear end having a maximum diameter less than that of said cushion ring and an axial dimension permitting said slip ring to embed into said cushion ring to softly cushion axial forces between said nut and gear and permit said cushion ring to directly engage said gear end during engine cranking.

11. In an electric starter for internal combustion engines including an electric motor having a casing, an end cap enclosing an end of the casing, a drive shaft extending through the end cap, threads defined on the drive shaft, a starter pinion gear assembly mounted on said shaft cooperating with the shaft threads axially movable between operative and inoperative positions, the gear assembly including a nut member engaging the shaft threads having a starter pinion gear rotatably mounted thereon, and gear assembly stop means mounted on the shaft, the improvement comprising, a first surface defined on the nut member disposed adjacent the casing end cap at the inoperative position of the pinion gear assembly, a second surface defined on the casing end cap closely spaced relative to said first surface at the inoperative position of the gear assembly, said surfaces defining a water entrapping clearance radially spaced from the drive shaft whereby water freezing within said clearance resists rotation of the nut member to assure relative rotation between the drive shaft threads and nut member upon initial rotation of the drive shaft.

12. In an electric starter as in claim 11, wherein said first surface comprises an annular axially extending shoulder defined on the nut member and an annular axially extending ridge defined on the end cap concentric to the drive shaft defining said second surface.

13. In an electric starter as in claim 12, an elastomeric cushion material bonded to the nut member having a cylindrical outer periphery, said elastomeric material outer periphery defining said first surface.

14. An electric starter for small internal combustion engines characterized by its dielectric character and ability to be safely operated under high moisture conditions comprising, in combination, an electric motor comprising a dielectric synthetic plastic casing having ends, dielectric synthetic plastic end caps mounted upon said casing ends, an armature shaft rotatably supported upon said end caps having an end extending exteriorly from said casing, starter pinion gear structure mounted upon said shaft end, an electric conductor cord extending from said casing, an electric switch assembly on said cord, said switch assembly comprising a moisture impervious dielectric receptacle having a cavity defined by side and end walls and a panel extending between said walls, an opening defined in said receptacle by an edge formed in said walls, a cord receiving opening defined in a wall intersecting the associated edge, an electrical connector receiving opening defined in a wall intersecting the associated edge, a dielectric cap mounted upon said receptacle edge enclosing and sealing said cavity opening, attachment means mounting said cap on said receptacle, an electric switch connected to said cord within said receptacle having an actuator extending therefrom, an actuator access opening defined in said receptacle panel receiving said switch actuator, sealing means hermetically sealing said actuator relative to said actuator access opening permitting actuation of said actuator, an electrical connector electrically associated with said switch, said connector including a compressible resilient body having a configuration similar to and slightly larger than said connector receiving opening whereby assembly of said cap upon said receptacle forces said body against said connector receiving opening in a sealed relationship, said receptacle end cap being formed of relatively rigid synthetic plastic material, said attachment means mounting said cap on said receptacle comprising sockets defined in said receptacle and pins homogeneously defined on said cap received within said sockets, said sockets having a transverse dimension slightly less than the transverse dimension of said pins producing an interference fit between the associated pins and sockets eliminating the need for adhesives or bonding materials, and resilient sealing means mounted on said cord received within said receptacle cord receiving opening sealing said cord with respect to said receptacle.

15. In an electric starter as in claim 14, said connector body being of a wedge configuration and said receptacle connector receiving opening being of a wedge configuration whereby assembly of said cap to said receptacle wedges said body into said opening.

* * * * *